US008240634B2

(12) United States Patent
Jarchau et al.

(10) Patent No.: US 8,240,634 B2
(45) Date of Patent: Aug. 14, 2012

(54) HIGH-PRESSURE VALVE ASSEMBLY

(75) Inventors: Michael Jarchau, Oelde (DE); Axel Sommerkamp, Oelde (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 654 days.

(21) Appl. No.: 12/362,624

(22) Filed: Jan. 30, 2009

(65) Prior Publication Data

US 2009/0194717 A1 Aug. 6, 2009

(30) Foreign Application Priority Data

Feb. 1, 2008 (DE) ..... 20 2008 001 458 U

(51) Int. Cl.
*F16K 31/12* (2006.01)

(52) U.S. Cl. ..... 251/29; 251/322; 251/324; 137/614.21

(58) Field of Classification Search ..... 251/28, 251/29, 30.01; 137/613, 614.13, 614.14, 137/614.19, 614.2, 614.21; 222/509, 511, 222/518; 92/165 R, 168
See application file for complete search history.

(56) References Cited

U.S. PATENT DOCUMENTS 3,820,922 A * 6/1974 Buse et al. ..... 417/539
4,111,392 A * 9/1978 Edelmann ..... 251/214
4,551,077 A * 11/1985 Pacht ..... 417/454
5,605,449 A * 2/1997 Reed ..... 417/454
5,848,880 A * 12/1998 Helmig ..... 417/560
6,435,010 B1 * 8/2002 Johnson et al. ..... 73/40
7,779,748 B2 * 8/2010 Alaze et al. ..... 92/129

* cited by examiner

*Primary Examiner* — John Fristoe, Jr.
*Assistant Examiner* — Jessica Cahill
(74) *Attorney, Agent, or Firm* — Henry M. Feiereisen; Ursula B. Day

(57) ABSTRACT

A high-pressure valve assembly includes a flange defining an axis. Projecting into the flange is a valve body which is sealed against the flange by a static ring seal. Provided on one side of the valve body is a spring-loaded closure member which is supported for movement in a direction of the axis to form a suction valve, and on another side of the valve body in opposition to the one side is a spring-loaded tappet which is supported for movement in the direction of the axis to form a pressure valve. A channel connects the suction valve with the pressure valve and has one end porting into a pressure chamber of the valve body adjacent to the pressure valve. The pressure chamber extends in axial direction of the tappet and is sized to extend substantially above a bottom edge of the ring seal.

23 Claims, 2 Drawing Sheets

HIGH-PRESSURE VALVE ASSEMBLY

CROSS-REFERENCES TO RELATED APPLICATIONS

This application claims the priority of German Patent Application, Serial No. 20 2008 001 458.1, filed Feb. 1, 2008, pursuant to 35 U.S.C. 119(a)-(d), the content of which is incorporated herein by reference in its entirety as if fully set forth herein.

BACKGROUND OF THE INVENTION

The present invention relates to a high-pressure valve assembly.

Nothing in the following discussion of the state of the art is to be construed as an admission of prior art.

High-pressure valve assemblies are used in high-pressure pumps by which a fluid is pressurized to a pressure of, for example, 4000 bar and above. The valve assembly has a pressure valve having a spring-loaded tappet which is movable in an axial direction and has an end surface to form a sealing surface resting against a complementary end surface of a valve body, when assuming a sealing position, so as to snugly seal a channel during a suction step. The suction valve includes a spring-loaded closure member of annular plate shape which rests on the other end surface of the valve body, when the fluid is set under pressure by a plunger and forced through the channel. In this situation, the closure member snugly seals an inlet on a suction side.

Practice has shown that the relevant parts of the valve assembly are exposed to significant mechanical stress as a consequence of the very high fluid pressure, e.g. tensile stress, causing a notch effect in particular in the outlet zone of the channel. As a result, the service life of the valve assembly is reduced and the applicability of the valve assembly for very high pressures is limited.

It would therefore be desirable and advantageous to provide an improved high-pressure valve assembly to obviate prior art shortcomings.

SUMMARY OF THE INVENTION

According to one aspect of the present invention, a high-pressure valve assembly includes a flange defining an axis, a valve body projecting into the flange, a static ring seal sealing the valve body against the flange, a spring-loaded closure member supported for movement in a direction of the axis on one side of the valve body to form a suction valve, a spring-loaded tappet supported for movement in the direction of the axis on another side of the valve body in opposition to the one side to form a pressure valve, and a channel connecting the suction valve with the pressure valve and having one end porting into a pressure chamber of the valve body adjacent to the pressure valve, said pressure chamber extending in axial direction of the tappet and sized to extend substantially above a bottom edge of the ring seal.

As in accordance with the present invention, the pressure-side tappet, when assuming the sealing position, projects into the chamber which has a bottom area in which the channel connects, an equilibrium of the hydrostatic pressure is established in radial direction when the tappet is moved axially in opposition to the spring force upon opening of the pressure valve, so that the presence of tensile stress in the outlet zone of the channel is avoided. As a result, there is no notch effect so that the stress on the valve body is minimized. The service life of the high-pressure valve assembly is thus increased and higher pressures can be absorbed so that the versatility of the valve assembly is significantly improved.

According to another advantageous feature of the present invention, the pressure chamber has a sidewall which may have at least one region to provide an axial guide surface for the tappet. As a result of the continuous support of the tappet in the valve body, the stress resistance of the high-pressure valve assembly is further enhanced.

According to another advantageous feature of the present invention, the closure member and the tappet may be arranged in coaxial disposition.

According to another advantageous feature of the present invention, the closure member may have a stepped pin which is movably supported in a bore of the valve body for guidance in the direction of the axis. The tappet may also have a stepped pin which projects into the pressure chamber and rests upon the guide surface.

According to another advantageous feature of the present invention, the stepped pin of the closure member may have a shoulder to define a sealing surface which rests against a complementary sealing surface of the valve body, when the closure member assumes a sealing position. The sealing surface of the shoulder may hereby be conical or flat (planar), i.e. transversely to the length axis.

According to another advantageous feature of the present invention, the stepped pin of the tappet may have a shoulder to define a sealing surface which rests against a complementary sealing surface of the valve body, when the tappet assumes a sealing position. The sealing surface of the shoulder may hereby be conical or flat (planar), i.e. transversely to the length axis. Suitably, the sealing surface of the tappet may have an end surface formed with a bevel.

According to another advantageous feature of the present invention, the valve body may have a concentric chamber adjacent to the suction valve, with the chamber having a wall surface having at least one region forming an axial guidance for the closure member.

According to another advantageous feature of the present invention, the valve body may have a bore for movably supporting and guiding the closure member. This design is beneficial as far as manufacture and operation are concerned.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 2:
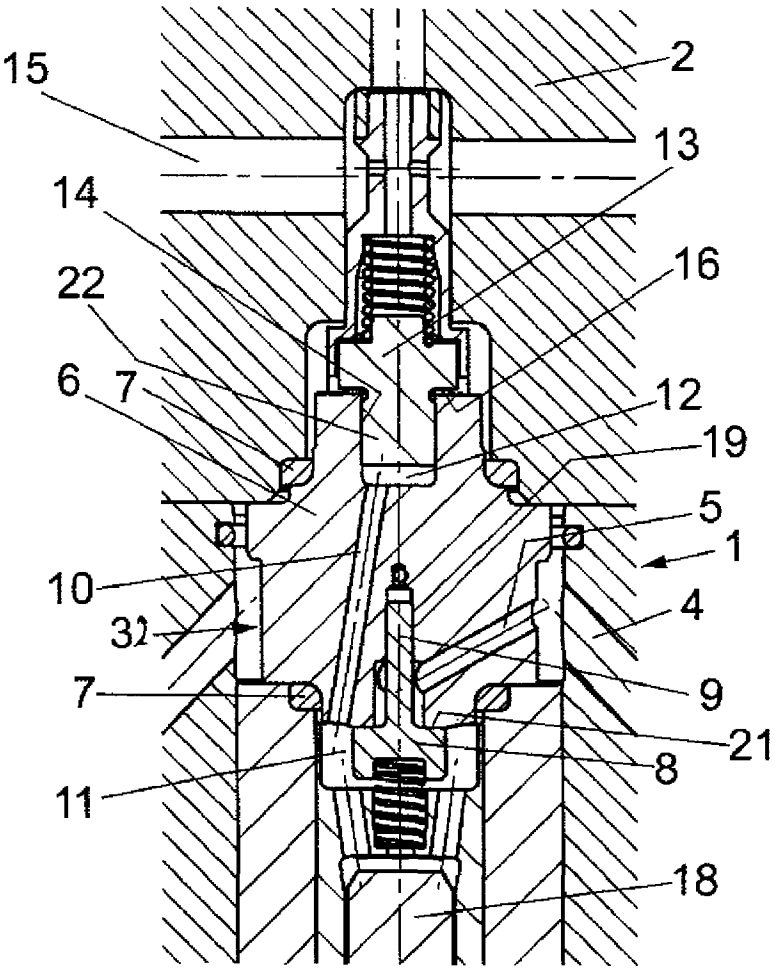
FIG. 2 is a sectional side view of a second embodiment of a high-pressure valve assembly according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1:
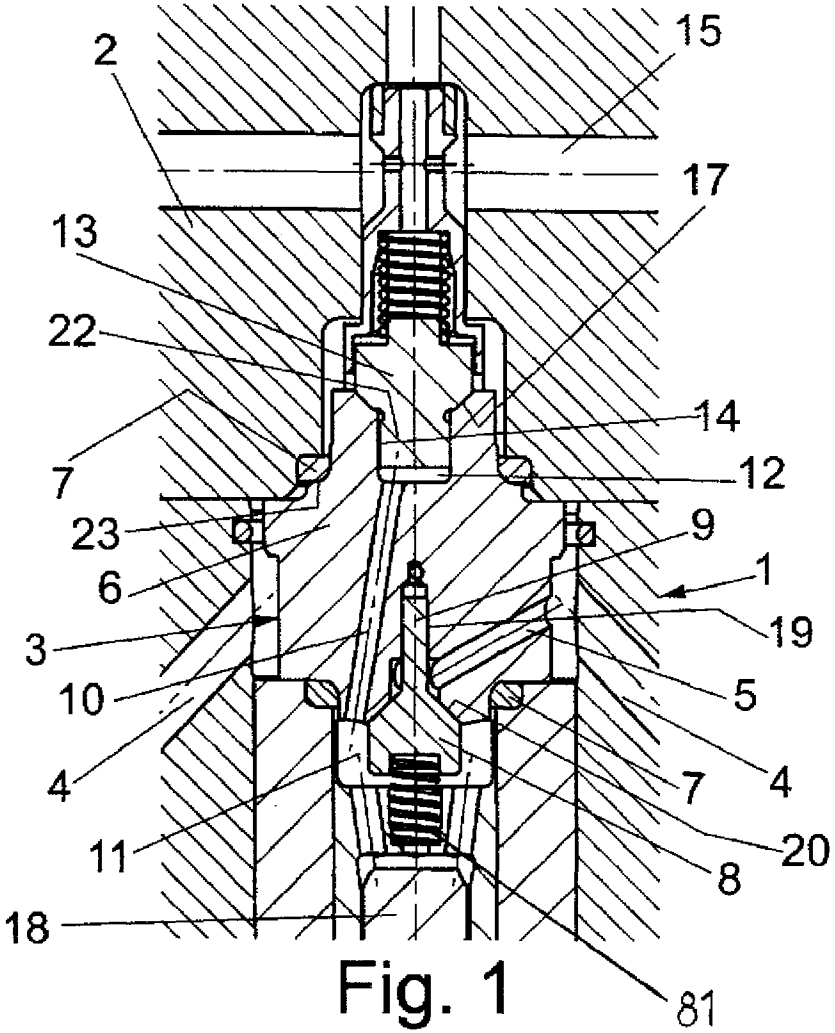
FIG. 1 is a sectional side view of a first embodiment of a high-pressure valve assembly according to the present invention.

Turning now to the drawing, and in particular to FIG. 1, there is shown a sectional side view of a first embodiment of a high-pressure valve assembly according to the present invention, generally designated by reference numeral 3 and including a valve body 6 which has a suction side supported in a housing 1 and a pressure side supported in a flange 2 which is connected to the housing 1. Static ring seals 7 are provided to seal the valve body 6 against the housing 1 and the flange 2, respectively.

The housing 1 is provided with inlet bores 4 for routing a fluid into a suction space 11 via a suction line 5 arranged in the valve body 6. The supply of fluid is controlled by a closure member 8 which is urged by spring 81 to rest snugly against the valve body 6 in order to close the suction line 5. The closure member 8 is formed with a pin 9 which extends axially for movement in a bore 19 of the valve body 6. The bore 19 thus forms a guidance for the pin 9 and hence also for the closure member 8.

When the suction line 5 is sealed off by the closure member 8, a plunger 18 forces fluid to flow through a channel 10 in the valve body 6 into a pressure chamber 12 of the valve body 6. The channel 10 ends hereby in a bottom region of the pressure chamber 12. Positioned in the pressure chamber 12 in coaxial relationship to the plunger 18 and the closure member 8 is a spring-loaded tappet 13 of a pressure valve to snugly seal the channel 10, when fluid is drawn in. The tappet 13 has a stepped configuration to include a pin 22, which projects into the pressure chamber 12, and a circumferential shoulder, which forms a sealing surface 17 for cooperation with a complementary sealing surface of the valve body 6. Both the sealing surface 17 of the tappet 13 and the associated sealing surface of the valve body 6 have a conical configuration. Likewise the closure member 8 has a sealing surface 20 which snugly rests upon a complementary sealing surface of the valve body 6.

The pressure chamber 12 is sized in such a way that a major part thereof extends above a bottom edge 23 of the static ring seal 7, when viewed in axial direction of the tappet 13. In the area of the stepped pin 22 of the tappet 13, the pressure chamber 12 forms guide surfaces 14 on which at least some areas of the outer surface area of the tappet 13 rest for axial guidance.

FIG. 2 shows a sectional side view of a second embodiment of a high-pressure valve assembly according to the present invention, generally designated by reference numeral 32. Parts corresponding with those in FIG. 1 are denoted by identical reference numerals and not explained again. The description below will center on the differences between the embodiments. In this embodiment, the tappet 13 has a circumferential shoulder, which forms a sealing surface 16 for cooperation with a complementary sealing surface of the valve body 6. Both the sealing surface 16 of the tappet 13 and the associated sealing surface of the valve body 6 have a flat or planar configuration, i.e. perpendicular to the length axis of the tappet 13. The closure member 8 has also a sealing surface 21 which snugly rests upon a complementary sealing surface of the valve body 6.

Figure 3:
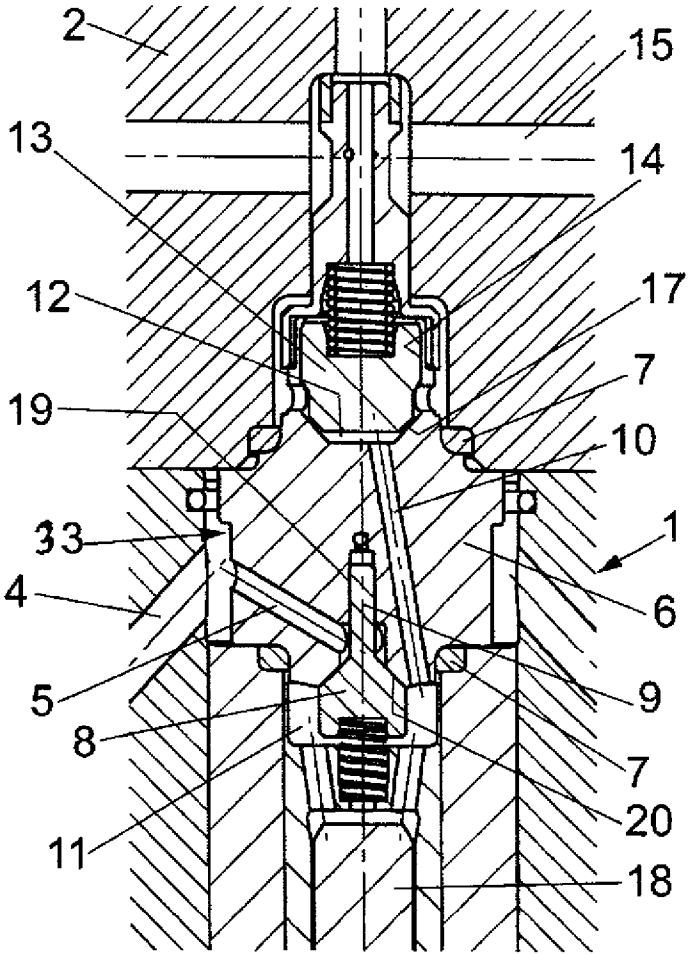
FIG. 3 is a sectional side view of a third embodiment of a high-pressure valve assembly according to the present invention.

FIG. 3 shows a sectional side view of a third embodiment of a high-pressure valve assembly according to the present invention, generally designated by reference numeral 33. Parts corresponding with those in FIGS. 1 and 2 are denoted by identical reference numerals and not explained again. The description below will center on the differences between the embodiments. In this embodiment, the tappet 13 has an end surface which together with the complementing surface of the pressure chamber 12 serves as sealing surface 17 for sealing the channel 10 which ends in the bottom region of the pressure chamber 12. The sealing surface 17 has a conical configuration formed with a bevel. The pressure chamber 12 conforms hereby in the contact zone to the sealing surface 17.

Figure 4:
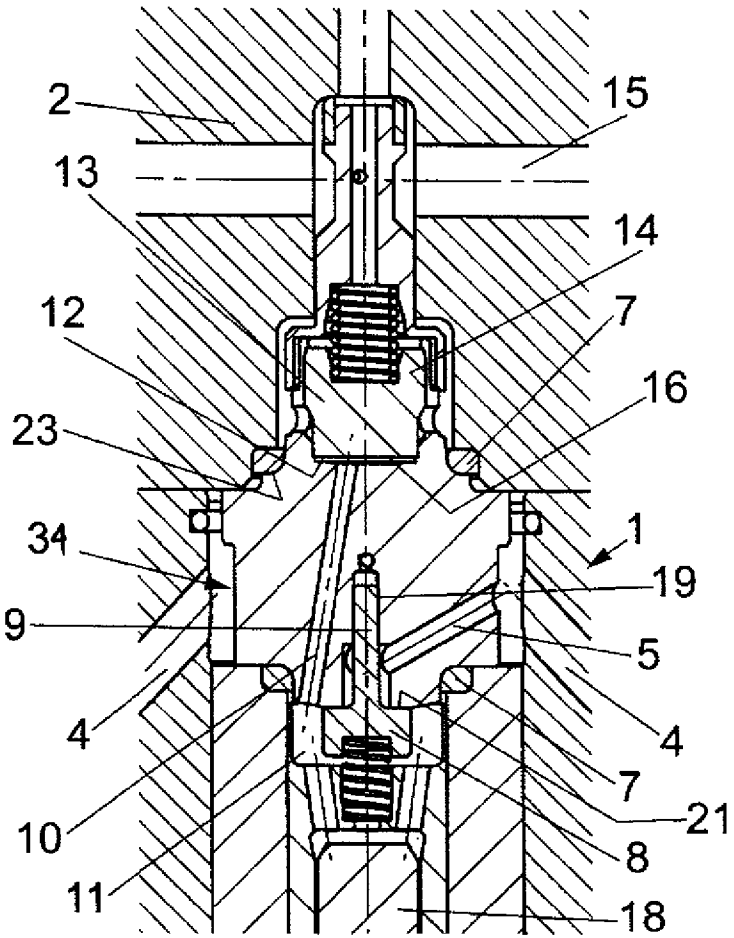
FIG. 4 is a sectional side view of a fourth embodiment of a high-pressure valve assembly according to the present invention.

FIG. 4 shows a sectional side view of a fourth embodiment of a high-pressure valve assembly according to the present invention, generally designated by reference numeral 34. Parts corresponding with those in FIGS. 1 to 3 are denoted by identical reference numerals and not explained again. The description below will center on the differences between the embodiments. In this embodiment, the tappet 13 has a planar end surface to form a sealing surface 16 of a configuration conforming to the bottom of the pressure chamber 12 upon which the sealing surface 16 rests. The wall of the pressure chamber 12 also forms a guide surface 14 for axial guidance of the tappet 13. Fluid is hereby routed between the tappet 13 and the guide surface 14 in open position to flow to an outlet 15.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A high-pressure valve assembly, comprising:

a flange defining an axis;

a valve body projecting into the flange and having a first stepped end section with an outside diameter smaller than an outside diameter of the valve body;

a pressure chamber formed as a blind hole in the first stepped end section of the valve body, said blind hole extending in the direction of the axis;

a static ring seal disposed proximate a transition between the valve body and the stepped end section for sealing the valve body against the flange;

a spring-loaded closure member supported for movement in a direction of the axis on a second end of the valve body opposite the first stepped end section to form a suction valve;

a spring-loaded tappet supported for movement in the pressure chamber in the direction of the axis in opposition to the movement of the spring-loaded closure member; and a channel formed in the valve body having one end porting into the pressure chamber and connecting the suction valve with the pressure chamber.

2. The valve assembly of claim 1, wherein the closure member and the tappet are arranged in coaxial disposition.

3. The valve assembly of claim 1, wherein the valve body has a concentric chamber adjacent to the suction valve, said chamber having a wall surface having at least one region forming an axial guidance for the closure member.

4. The valve assembly of claim 1, wherein the channel ports into a bottom area of the pressure chamber.

5. The valve assembly of claim 1, wherein the closure member has a stepped pin which is movably supported in a bore of the valve body for guidance in the direction of the axis.

6. The valve assembly of claim 5, wherein the stepped pin of the closure member has a shoulder to define a sealing surface which rests against a complementary sealing surface of the valve body, when the closure member assumes a sealing position.

7. The valve assembly of claim 6, wherein the sealing surface of the shoulder has a conical configuration.

8. The valve assembly of claim 6, wherein the sealing surface of the shoulder extends perpendicular in relation to an axial extent of the closure member and has a flat configuration.

9. The valve assembly of claim 1, wherein the pressure chamber has a sidewall which has at least one region to provide an axial guide surface for the tappet.

10. The valve assembly of claim 9, wherein the tappet has a stepped pin which projects into the pressure chamber and rests upon the guide surface.

11. The valve assembly of claim 10, wherein the stepped pin of the tappet has a shoulder to define a sealing surface which rests against a complementary sealing surface of the valve body, when the tappet assumes a sealing position.

12. The valve assembly of claim 11, wherein the sealing surface of the shoulder has a conical configuration.

13. The valve assembly of claim 11, wherein the sealing surface of the shoulder extends perpendicular in relation to an axial extent of the tappet and has a flat configuration.

14. The valve assembly of claim 11, wherein the sealing surface of the tappet has an end surface formed with a bevel.

15. The valve assembly of claim 11, wherein the sealing surface of the tappet is formed by an end surface of the tappet.

16. A high-pressure valve assembly, comprising:

a flange defining an axis;

a valve body projecting into the flange;

a static ring seal sealing the valve body against the flange and having a first stepped end section with an outside diameter smaller than an outside diameter of the valve body; a pressure chamber formed as a blind hole in the first stepped end section of the valve body, said blind hole extending in the direction of the axis;

a spring-loaded closure member supported for movement in a direction of the axis on one side of the valve body to form a suction valve;

a solid spring-loaded tappet supported for movement in the direction of the axis on another side of the valve body in opposition to the one side to form a pressure valve; and a channel connecting the suction valve with the pressure valve and having one end porting into a pressure chamber of the valve body adjacent to the pressure valve, said pressure chamber sized to extend substantially above a bottom edge of the ring seal.

17. The valve assembly of claim 16, wherein the valve body has a concentric chamber adjacent to the suction valve, said chamber having a wall surface having at least one region forming an axial guidance for the closure member.

18. The valve assembly of claim 16, wherein the channel ports into a bottom area of the pressure chamber.

19. The valve assembly of claim 16, wherein the closure member has a stepped pin which is movably supported in a bore of the valve body for guidance in the direction of the axis.

20. The valve assembly of claim 19, wherein the stepped pin of the closure member has a shoulder to define a sealing surface which rests against a complementary sealing surface of the valve body, when the closure member assumes a sealing position.

21. The valve assembly of claim 16, wherein the tappet has a stepped pin which projects into the pressure chamber and rests upon a sidewall of the pressure chamber forming a guide surface.

22. The valve assembly of claim 21, wherein the stepped pin of the tappet has a shoulder to define a sealing surface which rests against a complementary sealing surface of the valve body, when the tappet assumes a sealing position, with the sealing surface of the shoulder extending perpendicular in relation to an axial extent of the tappet and having a flat configuration.

23. The valve assembly of claim 21, wherein the stepped pin of the tappet has a shoulder to define a sealing surface which rests against a complementary sealing surface of the valve body, when the tappet assumes a sealing position, with the sealing surface of the tappet being formed by an end surface of the tappet.

* * * * *